United States Patent [19]

Fong et al.

[11] Patent Number: 5,065,874

[45] Date of Patent: Nov. 19, 1991

[54] PRESHORTENING INSERT FOR A DRAFT GEAR

[75] Inventors: Ding-Huei R. Fong, Aurora; Richard A. Carlstedt, Wheaton, both of Ill.

[73] Assignee: Miner Enterprises, Inc., Geneva, Ill.

[21] Appl. No.: 600,876

[22] Filed: Oct. 22, 1990

[51] Int. Cl.[5] ..... B61G 9/10

[52] U.S. Cl. ..... 213/31; 213/32 C; 213/64

[58] Field of Search ..... 213/22, 31, 32 R, 32 A, 213/32 B, 32 C, 64, 65; 188/376, 377; 293/133; 52/98, 99, 100; 285/3, 4; 246/172

[56] References Cited

U.S. PATENT DOCUMENTS

| | | | |
|---|---|---|---|
| 2,251,347 | 8/1941 | Williams et al. . | |
| 2,729,343 | 1/1956 | Brosnan . | |
| 2,857,056 | 10/1958 | Dilworth . | |
| 3,227,288 | 1/1966 | Mulcahy et al. . | |
| 3,403,790 | 10/1968 | Zanow | 213/32 R |
| 3,493,082 | 2/1970 | Bell . | |
| 3,608,677 | 9/1971 | Wykes . | |
| 3,637,051 | 1/1972 | Paine et al. . | |
| 3,799,360 | 3/1974 | Huml et al. | 213/22 |
| 3,847,426 | 11/1974 | McGettigan . | |
| 3,856,153 | 12/1974 | Cope . | |
| 3,966,057 | 6/1976 | Duquette et al. . | |
| 4,537,304 | 8/1985 | Kaim et al. . | |

FOREIGN PATENT DOCUMENTS

| | | | |
|---|---|---|---|
| 545957 | 9/1957 | Canada | 213/32 C |

OTHER PUBLICATIONS

Railway Age, "Why Couplers Stay Open When the Southern Humps Cars", May 12, 1952.

ASIM Designation B426-83a, "Standard Specification For Sintered Copper-Steel Structural Parts".

*Primary Examiner*—Margaret A. Focarino

*Assistant Examiner*—Joseph D. Pape

[57] ABSTRACT

A fragmentable insert for maintaining a railroad draft gear in a shortened state to facilitate assembly in the pocket of a railroad car. The insert is a generally rectangular structure having at least one set of opposing faces bisected by a pair of grooved notches. The two sets of grooved notches are generally perpendicular to each other. A bore extends through the body of the insert between the opposing faces which are bisected by the grooved notches. The bore is configured to reduce the thickness of the material between its wall surface and the surfaces of the other pairs of opposing faces not intersected by the bore.

4 Claims, 2 Drawing Sheets

45
50
54a
49
49a
47
45a
50a
54

47a
49
52
48
48a
52a
60
45a
45
47

47a
50
45
28
70
72
48
49
60
44
49a
47

PRESHORTENING INSERT FOR A DRAFT GEAR

FIELD OF INVENTION

This invention relates to gagging devices for preshortening a railroad car draft gear and more particularly to a preshortening insert which is designed to hold the draft gear in a preshortened state while the draft gear and related elements are assembled in the pocket of the railroad car. Once assembly has been completed and the railroad car put in service, the preshortening insert is designed to fragment and release the draft gear to a work performing state.

BACKGROUND OF THE INVENTION

As is well known in the prior art, a draft gear, in order to be installed into the sill of the freight car, must be in a partially compressed state. In service, the housing of the draft gear abuts the rear draft stops of the car structure while the wedge or friction parts press against the follower plate, which in turn abuts the front draft stops. This spring-loaded state is maintained by the draft gear's internal spring means. Since the space available between the front and rear draft stops is approximately one-quarter to three-eights inch less than the length of an ungagged draft gear and the follower plate combined, it is apparent that the draft gear must be precompressed and held in that state prior to positioning within the pocket.

To overcome this problem of preshortening, the railroad industry has for many years insisted that manufacturers of draft gears furnish the draft gear in a precompressed or gagged state. In this preshortened condition, the draft gear is at an over-all length which is approximately one-quarter to three-eights inch less than the length at which the gear would be when situated within the pocket in service. When in such a reduced length or compressed state, the draft gear and follower plate can easily be inserted between the draft stops. It is further an industry requirement that the preshortened draft gear, of its own accord, be able to self-extend and become tight in the draft pocket once service has begun. In essence, a draft gear manufacturer must provide a means by which his draft gear can be first precompressed, then held in that precompressed length for an indefinite period of time until the unit is put in service within a freight car, after which time the preshortening means must disengage. The preshortening requirements of the railroad industry have always presented a dilemma for the draft gear manufacturer. A preshortening device must be strong enough to hold a draft gear, some of which are designed to take shocks of up to 1,000,000 lbs., in a precompressed state while it is shipped, stored and otherwise handled. It must then be weak enough to be relatively disengageable when it is placed in actual service in the freight car. Should the preshortening insert be too weak, it can be triggered or fragmentated while handling, shipping or whatever; and should it be too strong, it will continue to maintain the draft gear in a gagged condition even after the railroad car is placed in a working environment. This results in increased coupler slack and additional distress to the draft stops as a result of the draft gear being loose within the pocket.

It has been the common practice with draft gears such as those shown in U.S. Pat. No. 3,227,288 to H. W. Mulcahy et al, dated Jan. 4, 1966, and U.S. Pat. No. 3,966,057 to Francis H. Duquette et al, dated June 29, 1976, to employ fragmentable preshortening inserts.

These preshortening inserts, when subjected to external forces during a work cycle which exceed their yield point, fracture or disintegrate and thus release the draft gear from the compressed state. Often times these preshortening inserts are composed of powdered metal mixtures. For example, a preshortening insert has been employed in the draft gear identified above in U.S. Pat. No. 3,966,057 which is a powdered metal mixture and has a generally solid, generally cubic structure. Even though all of the edges of the generally cubic structure have been chamfered, it has been found that such preshortening inserts from time to time in service do not fragment and release the draft gear from the gagged state.

SUMMARY OF THE INVENTION

The present invention is of the general category of the above-described powdered metal devices and is, in fact, adapted to be incorporated into the same draft gears disclosed above. The instant invention includes an embodiment of a preshortening insert which, due to the shape of its fabrication, will hold the draft gear in a gagged state and yet fragment when in a actual working cycle within the railroad car. As will be more fully explained in the attached drawings and description, the preshortening insert hereunder consideration is comprised of a powdered material and mixture which is identified as MPIF STANDARD 35, MATERIAL DESIGNATION FC-0508, the full text of which is incorporated herein. This standard may be ordered from Metal Powder Industries Federation, 105 College Road East, Princeton, N.J. 08540. The so fabricated preshortening insert also includes a series of structural elements which generally insure the desired fragmentation. These include the provision of a generally box-shaped or cubic body so that the yield forces in any direction will be similar. Further, two sets of groove notches are provided on opposite faces of the cube; the two sets of grooved notches are connected by a bore which passes through generally the center of the generally cubic structure. The combination of the notches and the bore serve to reduce the wall thickness and segment the preshortening insert such that it will fragment into at least two and probably four generally equal portions.

A BRIEF DESCRIPTION OF THE DRAWINGS

DESCRIPTION OF THE PREFERRED EMBODIMENT

Figure 1:
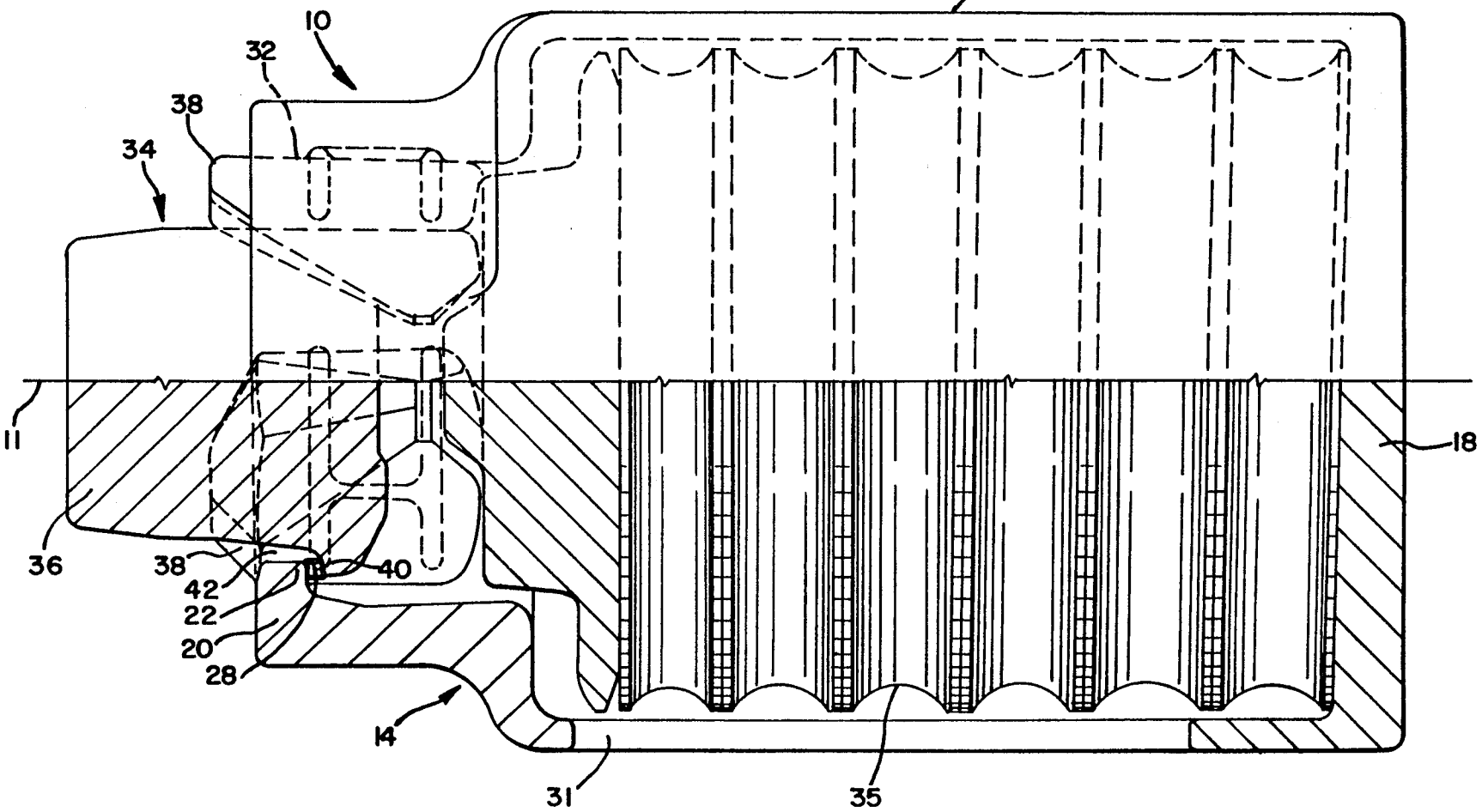
FIG. 1 is a partially broken away plan view of a draft gear showing the environment of the present invention.

Shown in FIG. 1 is a draft gear mechanism typical of the environment wherein the present invention functions. The draft gear 10 is designed to absorb forces transmitted along its major axis 11 in either direction. It includes a housing or casing 14 having a main body portion 16 of rectangular cross section, a rear end closure wall 18 and a front end section 20. The front end section 20 is provided with radially inwardly directed lugs 22, and with tapered inner friction surfaces 32 that converge in a direction toward the rear end of the casting 18.

Arranged within and projecting from the front end section 20 is a force transmitting friction clutch means 34 comprised of a friction wedge 36 and three wing-like friction shoes 38. The wedge 36 is provided with radially outwardly directed lugs 40 which are engaged behind the casting lug 22 to restrain the wedge 36 and the shoes 38 against movement outwardly of the casing. After assembly of the draft gear and prior to shipment, a preshortening insert 28 is positioned between each radially inwardly directed lug 22 and the radially outwardly directed lug 40. For a full discussion of a draft gear as herein shown, reference should be made to Duquette et al, U.S. Pat. No. 3,966,057—Draft Gear Mechanism and Method of Assembling Same—Issued June 29, 1976, which is incorporated herein by reference.

In actual practice, the fully assembled draft gear is subjected to an external load which compresses it, that is, shortens its length by about 1". The preshortening insert 28 is then dropped through the space between the wedge 36 and the casting lug 22. As shown in FIG. 1, this is the space identified as 42. As is apparent, the draft gear shown in FIG. 1 is lying on its side when in service. During the preshortening procedure, it would be orientated so that it would be standing on the rear end closure wall 18. Once dropped through the opening 42, the preshortening insert tumbles to the position shown in FIG. 1 in an orientation with respect to its elements which is totally random. In service in a freight car, the friction clutch means 34 will be driven inward of the housing 14 and compress the spring means 35. During return of the friction clutch means 34 by the spring means 35, the preshortening insert 28 will be struck a fracturing blow by the wedge lug 40, as it is hammered against the housing lug 22.

Figures 2, 3, 4:
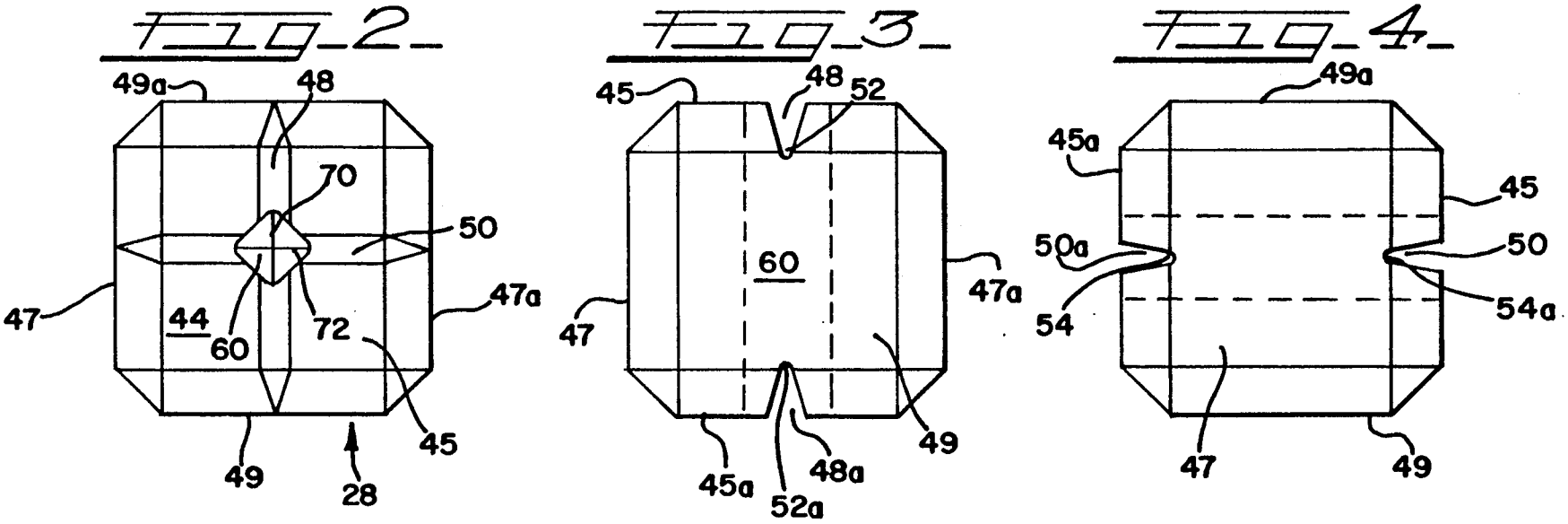
FIG. 2 is a top view of the preshortening insert.
FIG. 3 is a side view of the preshortening insert.
FIG. 4 is another view of FIG. 2 wherein the preshortening insert of FIG. 2 has been rotated 90 degrees to the right.

Referring now to FIGS. 2, 3 and 4, wherein is shown a preferred embodiment of the preshortening insert 28. As previously stated, the preshortening insert 28 is designed to fragment after two to six impacts at speeds of 2.9 miles per hour. Obviously, impacts at higher speeds or impacts involving fully loaded cars will play a substantial role in fragmentation. However, fragmentation when it does occur in the optimum situation will break the preshortening insert 28 into four generally uniform parts and although acceptable, but not nearly as desirably, into two parts. In either situation, the fragmentation into either two or four parts is sufficient to release the draft gear to its fully operable state.

Refer now specifically to the preshortening insert 28 as shown in FIG. 2. The body portion 44 is of a generally rectangular shape and in a preferred embodiment is generally cubic. The fabrication of the preshortening insert 28 involves standard powdered metal sintering technology. The particular mixture involved herein is a copper steel. As shown in FIGS. 2–4, all of the edges of the body portion of 44 are chamfered. It is also apparent that there are three pairs of opposing side faces 45, 45*a*, 47, 47*a* and 49, 49*a*. For example, in FIG. 2, opposing side face 49 has an identical face 49*a* on the opposite side of the body portion 44. The same is true with respect to FIGS. 3 and 4. That is, the remaining two pairs of opposite side faces are identical to the views in FIGS. 3 and 4. Thus, when reference is made to an opposing side face, it will be understood that the other side face of that pair is identical. Thus, when the first and second notch means 48 and 50 are discussed, it is understood that the notch system on the opposing face is identical and identified as 48*a* and 50*a*. This is partially shown in FIGS. 3 and 4 wherein the pair of notches 48, 48*a* and 50, 50*a* are displayed. The first and second notches bisect at least one pair of the opposing side faces, for example, 45 and 45*a*. In the preferred embodiment, the first and second notches are generally perpendicular to each other and are "V"-shaped. Additionally, the notches have major axes which are co-extensive with the bottom 52, 52*a* and 54, 54*a* of the "V"s. These major axes are perpendicular to the opposing faces 47, 47*a* and 49, 49*a* which they intersect. In the preferred embodiment, wherein the body portion 28 is generally cubic, this arrangement divides the cube into four generally equal potential fragments.

Extending from the first opposite side face 45 through the generally rectangular body portion 44, to the opposite side face 45*a*, is a bore 60. The purpose and design of the bore 60 in broad terms is to reduce the material thickness which lies between it and the surface of the closest sidewall 47, 47*a*, 49 or 49*a*; this to insure that the fragmentation takes place in a predetermined area along a predetermined path. In a preferred embodiment, the bore 60 has a square configuration, such as shown in FIG. 2.

First and second diagonal axes 70 and 72 extend between pairs of said corners of said bore means 60. These diagonal axes 70 and 72 are co-extensive with said major axes which are coextensive with the bottoms 52, 52*a* and 54, 54*a* of said "V"-shaped notches whereby aiding and assisting in the fragmentation of the preshortening insert into either two or four generally uniform fragments.

While there have been shown and described preferred embodiments of the present preshortening insert, it will be understood by those skilled in the art that various rearrangements and modifications may be made therein without departing from the scope and spirit of the invention.

What is claimed is:

1. A preshortening insert for the purpose of gagging a draft gear, said insert comprising:

a generally rectangular body portion, comprised of a powdered metal mixture, having all edges chamfered and having three pairs of opposite side faces;

a pair of first and second notches bisecting at least one pair of said opposite side faces, said first and second notches being generally perpendicular to each other;

a square bore having corners and first and second diagonal axes extending between pairs of said corners, extending through said generally rectangular body portion, said first and second diagonal axes being co-extensive with said first and second notches whereby when said preshortening insert is subjected to draft gear generated forces which exceed its yield point, said preshortening insert fractures, releasing said draft gear.

2. The preshortening insert of claim 1 wherein:

said generally rectangular body portion is cubic; and said first and second notches are generally "V"-shaped and have major axes, said major axis being generally perpendicular to said other pairs of opposite side faces.

3. A preshortening insert for the purpose of gagging a draft gear, said insert comprising:

a generally cubic body portion having three pairs of opposite side faces;

a pair of first and second notches bisecting a first pair of said opposite side faces; and a bore extending through said cubic body having a configuration to reduce material thickness between said bore and said other two pairs of opposite side faces.

4. The preshortening insert of claim 3 wherein said bore is a square bore having corners extending through said generally cubic body portion between said first pair of opposite side faces and being orientated to reduce material thickness between said corners and said second and third pairs of opposite side faces.

* * * * *